US007670178B2

(12) United States Patent
Gu et al.

(10) Patent No.: US 7,670,178 B2
(45) Date of Patent: Mar. 2, 2010

(54) ELECTRICAL CONNECTORS WITH IMPROVED ENGAGING ARMS

(75) Inventors: Hao Gu, Kunshan (CN); Qi-Sheng Zheng, Kunshan (CN); Lun-Song Hu, Kunshan (CN); Yong-Gang Wang, Kunshan (CN); Yu-Feng He, Kunshan (CN); Guang-Qian Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 265 days.

(21) Appl. No.: 11/899,190

(22) Filed: Sep. 4, 2007

(65) Prior Publication Data

US 2008/0057786 A1 Mar. 6, 2008

(51) Int. Cl.
*H01R 13/648* (2006.01)

(52) U.S. Cl. ..... 439/607

(58) Field of Classification Search ..... 439/607–609
See application file for complete search history.

(56) References Cited

U.S. PATENT DOCUMENTS 6,053,773 A 4/2000 Wu
6,478,622 B1 * 11/2002 Hwang ..... 439/607
7,097,507 B1 * 8/2006 Zhang et al. ..... 439/609
7,445,506 B2 * 11/2008 Ma ..... 439/607

FOREIGN PATENT DOCUMENTS

CN 2507155 Y 8/2002
CN 2783559 Y 5/2006
TW 438097 5/2001

* cited by examiner

*Primary Examiner*—Renne Luebke
*Assistant Examiner*—Larisa Tsukerman
(74) *Attorney, Agent, or Firm*—Wei Te Chung

(57) ABSTRACT

An electrical connector for mating with a plug includes an insulative housing, a number of contacts retained in the insulative housing, a metal shield and at least one metal spring fixed to the metal shield. The metal spring and the metal shield are made of different materials. The metal shield covers the insulative housing to define a receiving cavity formed by a plurality of peripheral walls. One of the peripheral walls defines a slot communicating with the receiving cavity. The metal spring is securely fixed to the peripheral walls and including an engaging arm extending into the receiving cavity through the slot.

14 Claims, 16 Drawing Sheets

ELECTRICAL CONNECTORS WITH IMPROVED ENGAGING ARMS

BACKGROUND OF THE INVENTION

1. Field of the Invention

The present invention relates to electrical connectors, and more particularly to electrical connectors with improved engaging arms for abutting against plugs inserted therein.

2. Description of Related Art

U.S. Pat. No. 6,053,773 discloses a conventional electrical connector comprising an insulative housing with a plurality of contacts retained therein and a pair of front and rear metal shield enclosing the insulative housing. The insulative housing comprises a base portion and a horizontal tongue plate portion extending forwardly from a front face of the base portion. The front metal shield encloses the tongue plate portion to define a receiving cavity for accommodating a plug therein. The front metal shield is stamped from a unitary one-piece metal sheet to have a generally rectangular configuration with four peripheral walls including an upper wall, a bottom wall and a pair of side walls. Each of the upper and the lower walls has a pair of engaging arms stamped therefrom and extending into the receiving cavity for abutting against the inserted plug to provide a stable mating status. Nowadays, in order to provide longtime mating cycles with the plug inserted/removable into/from the receiving cavity, the engaging arms are need to be made of material with excellent mechanical property, such as stainless steel. However, under this circumstance, if the engaging arms are integrally stamped from the front metal shield as disclosed in the prior art, the four peripheral walls might use the same material as that of the engaging arms because the front metal shield are formed of a one-piece metal sheet. In fact, the four peripheral walls needn't to be made of such excellent, but expensive, material, thereby increasing the cost of the electrical connector.

Hence, an electrical connector with improved engaging arms is needed to solve the problem above.

BRIEF SUMMARY OF THE INVENTION

Accordingly, an object of the present invention is to provide an electrical connector having an engaging arm and a metal shield which are made of different material in order to decrease the cost of the electrical connector.

An electrical connector for mating with a plug includes an insulative housing, a plurality of contacts retained in the insulative housing, a metal shield and at least one metal spring fixed to the metal shield. The insulative housing comprises a base portion and a tongue plate portion integrally extending forwardly from the base portion. The metal shield encloses the insulative housing to define a receiving cavity into which the tongue plate portion extends. The receiving cavity is formed by a plurality of peripheral walls. One of the peripheral walls defines a slot communicating with the receiving cavity. The metal spring is securely fixed to the peripheral wall and includes an engaging arm extending into the receiving cavity through the slot. The metal spring and the metal shield are made of different materials wherein the material of the metal spring is much better than that of the metal shield. For example, the metal shield is made of common iron sheet while the metal spring is made of stainless steel in order to provide longtime mating cycles while mating with the plug. Since iron is much cheaper than stainless steel, thereby, the cost of the electrical connector is decreased.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
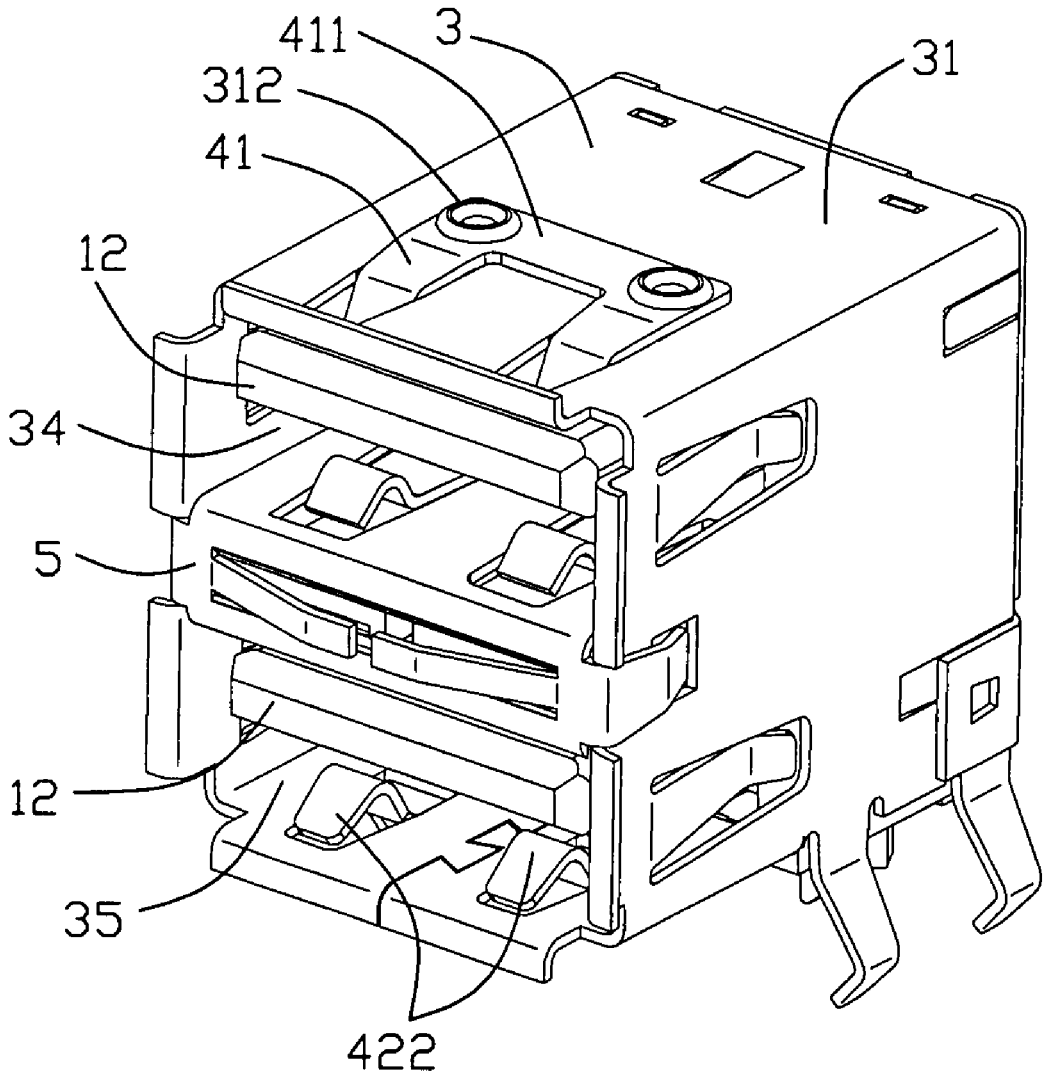
FIG. 1 is a front perspective view of an electrical connector according a first embodiment of the present invention.
Figure 2:
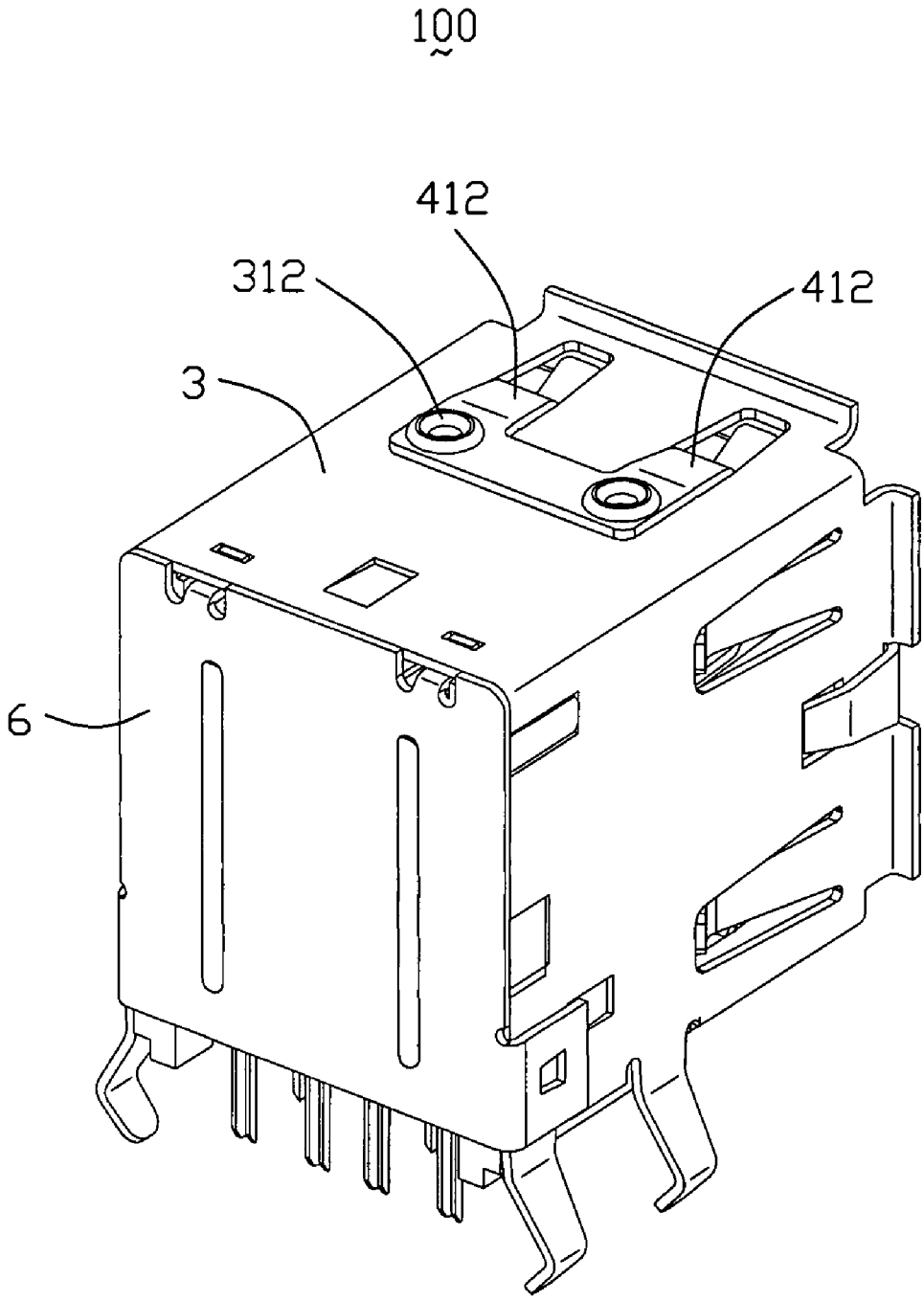
FIG. 2 is a rear perspective view of the electrical connector.
Figure 3:
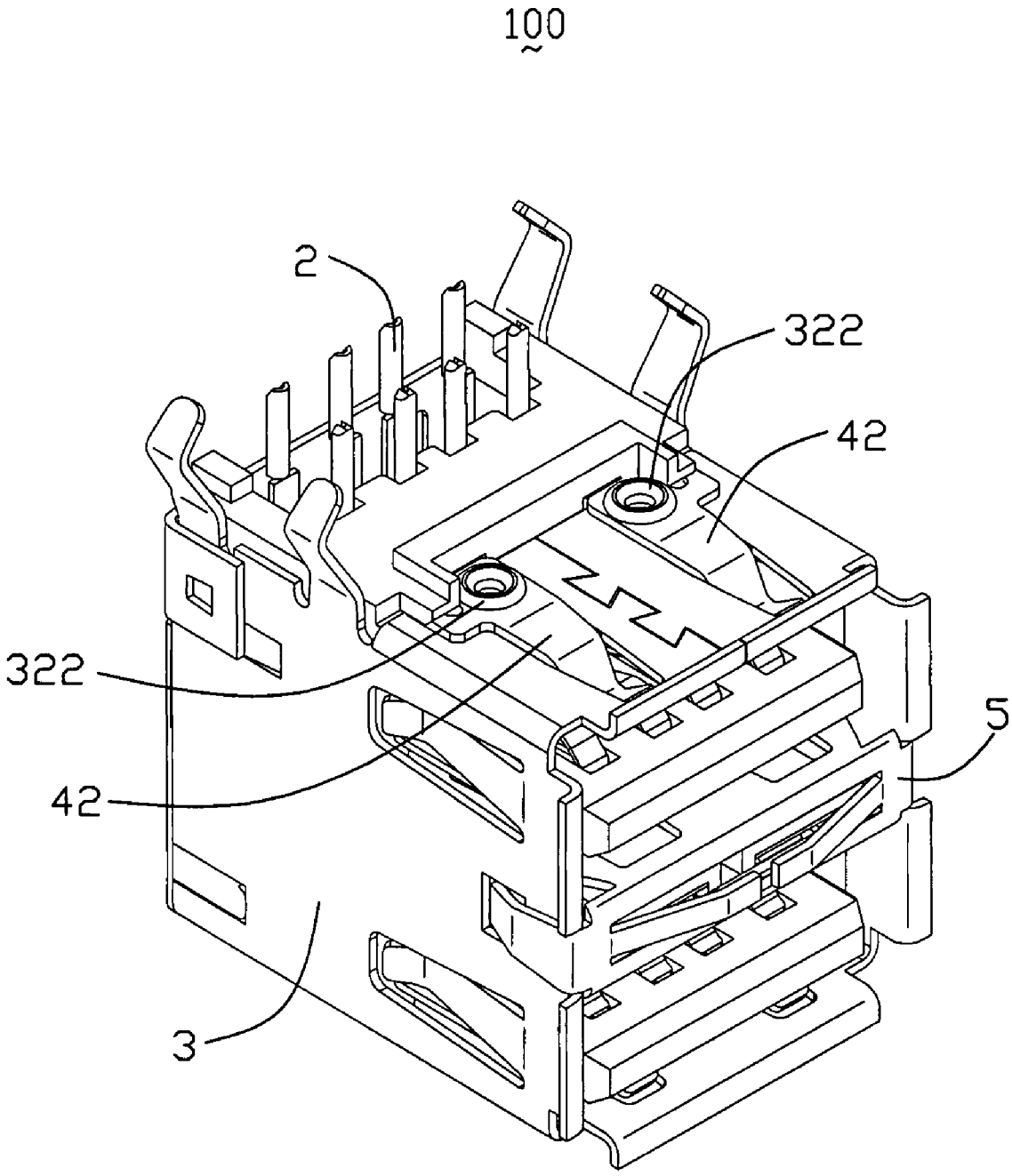
FIG. 3 is a bottom perspective view similar to FIG. 2, but viewed from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-4, an electrical connector 100 for mating with a plug (not shown) is disclosed according to a first embodiment of the present invention. The electrical connector 100 includes an insulative housing 1, a plurality of contacts 2 retained in the insulative housing 1, a front metal shield 3 enclosing the insulative housing 1, a rear metal shield 6 attached to the front metal shield 3 and a plurality of metal springs 4 assembled on the front metal shield 3.

Figure 4:
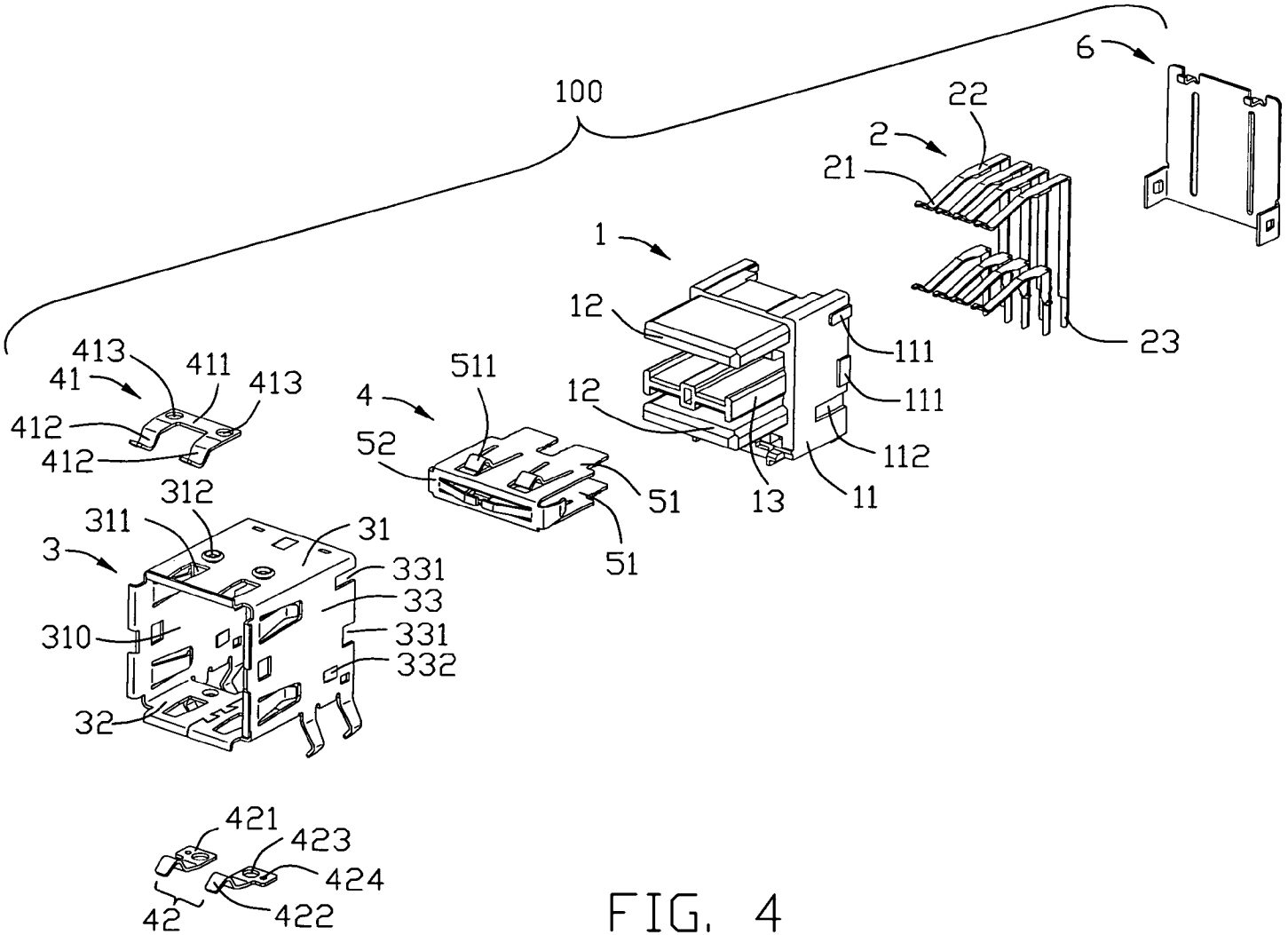
FIG. 4 is an exploded perspective view of the electrical connector shown in FIG. 1.
Figure 5:
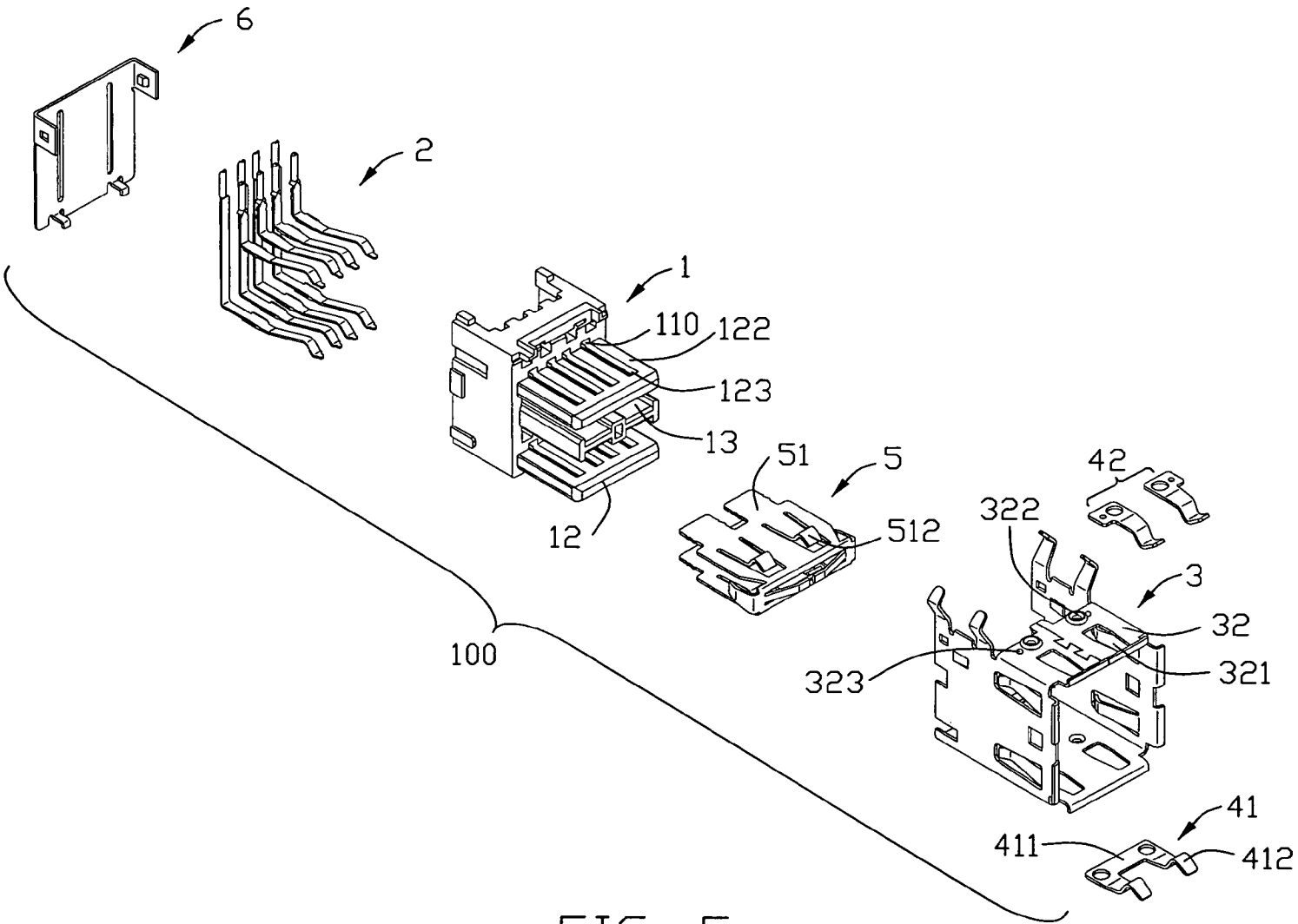
FIG. 5 is another exploded view similar to FIG. 4, while taken from another aspect.

Referring to FIGS. 4-5, the insulative housing 1 is formed by plastic injection molding to have a base portion 11, a pair of parallel tongue plate portions 12 integrally extending forwardly from the base portion 11 and a separate portion 13 located between the tongue plate portions 12 along a vertical direction. Each tongue plate portion 12 defines a plurality of horizontal passageways 123 on a lower surface 122 thereof as shown in FIG. 5. The base portion 11 defines a plurality of grooves 110 communicating with the passageways 123 for receiving the contacts 2 therein. The base portion 11 comprises a plurality of ribs 111 and a depression 112 on lateral sides thereof for abutting against the front metal shield 3.

The plurality of contacts 2 are divided into two groups which will be retained in the pair of tongue plate portions 12, respectively. Each of the contacts 2 is formed to have a generally L-shaped configuration with a retaining portion 22, a contact portion 21 extending forwardly from one end of the retaining portion 22 and a tail portion 23 bending downwardly from the other end of the retaining portion 22.

The front metal shield 3 is stamped from a unitary one-piece metal sheet to have a generally rectangular configuration. The front metal shield 3 includes four peripheral walls designated respectively a top wall 31, a bottom wall 32 and a pair of side walls 33. The peripheral walls cooperatively define an inner space 310 for receiving the insulative housing 1. The top wall 31 defines a pair of upper slots 311 and a pair of hollow protrusions 312 located at the rear of the corresponding upper slots 311. The protrusions 312 are stamped upwardly from the top wall 31 and perpendicular to the top wall 31 along the vertical direction. The bottom wall 32 defines a pair of lower slots 321 corresponding to the upper slots 311 and another pair of hollow protrusions 322 located at the rear of the corresponding lower slots 321. The protrusions 322 are stamped downwardly from the bottom wall 32 and perpendicular to the bottom wall 32 along the vertical direction. The side walls 33 define a plurality of slits 331 for receiving the ribs 111 of the insulative housing 1 and a tab 332 extending into the inner space 310 for abutting against the depression 112 of the insulative housing 1. The front metal shield 3 is assembled to the insulative housing 1 to form a pair of upper and lower receiving cavities 34, 35 for the pair of tongue plate portions 11 respectively extending therethrough as shown in FIG. 1. The contact portions 21 of the contacts 2 extend beyond the lower surface 122 of the tongue plate portion 11 and extend into the upper and lower receiving cavities 34, 35 for mating with the plugs.

Referring to FIGS. 4-5, the electrical connector 100 further comprises an inner metal shield 5 enclosing the separate portion 13. The inner metal shield 5 comprises a vertical front wall 52 and a pair of top and bottom walls 51 extending rearwardly from top and bottom edges of the front wall 52. The top and bottom walls 51 respectively define a pair of upper and lower spring arms 511, 512 stamped outwardly therefrom. The upper and lower spring arms 511, 512 protrude into the upper and lower receiving cavities 34, 35, respectively, for abutting against the plugs.

The metal springs 4 comprise a first metal spring 41 attached to an outer surface of the upper wall 31 of the front metal shield 3 and a pair of second metal springs 42 attached to the bottom wall 32 of the front metal shield 3. The first metal spring 41 comprises a first retaining base 411 and a pair of first engaging arms 412 cantileveredly extending from lateral edges of the first retaining base 411. The first retaining base 411 defines a pair of first through holes 413 for the protrusions 312 extending therethrough. Each second metal spring 42 comprises a second retaining base 421 and a second engaging arm 422 extending forwardly from the second retaining base 421. The second retaining base 421 defines a second through hole 423 on a rear end thereof for the another protrusions 322 extending therethrough. All the protrusions 312, 322 are riveted to abut against the corresponding first and second metal springs 41, 42 in order that the first and second metal springs 41, 42 can be fixed on the top and bottom walls 31, 32, respectively. The first and the second engaging arms 412, 422 extend into the first and the second receiving cavities 34, 35, respectively, for abutting against the plugs. Each second retaining base 421 defines another second through hole 424 adjacent to the second through 423 wherein the another second through hole 424 is much smaller than the second through 423. The bottom wall 32 further defines a pair of projections 323 for receiving the another second through holes 424 so that the pair of second metal springs 42 can be fixed in a preliminary position before rivet process. The front metal shield 3 includes four peripheral walls among which one of the peripheral wall is a mounting wall to which the metal springs 4 is attached. In the first preferred embodiment of the present invention, the mounting wall is the top wall 31 or the bottom wall 32 of the front metal shield 3. However, in other embodiments, the mounting wall can be the pair of side walls 33 of the front metal shield 3.

Figure 6:
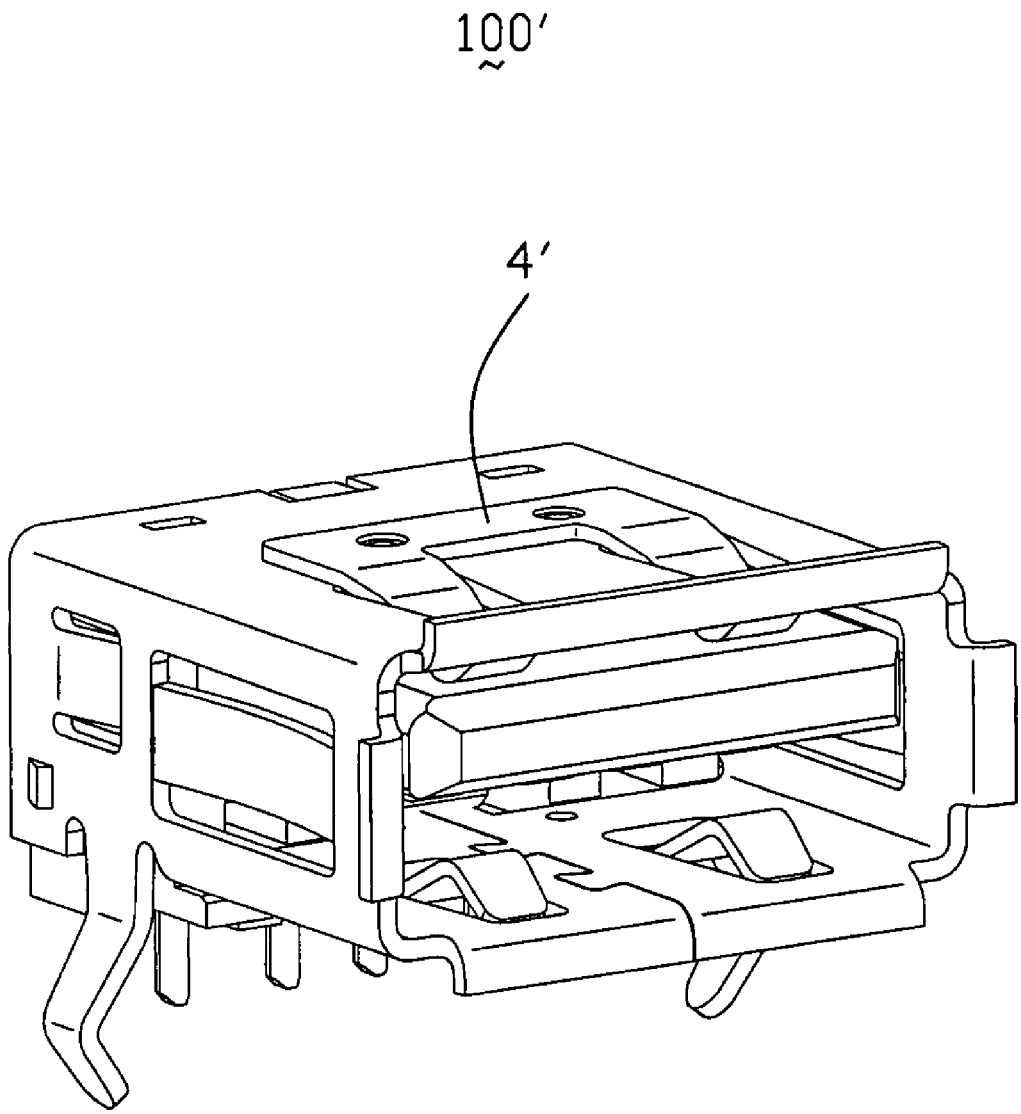
FIG. 6 is a perspective view of an electrical connector according to a second embodiment of the present invention.
Figure 7:
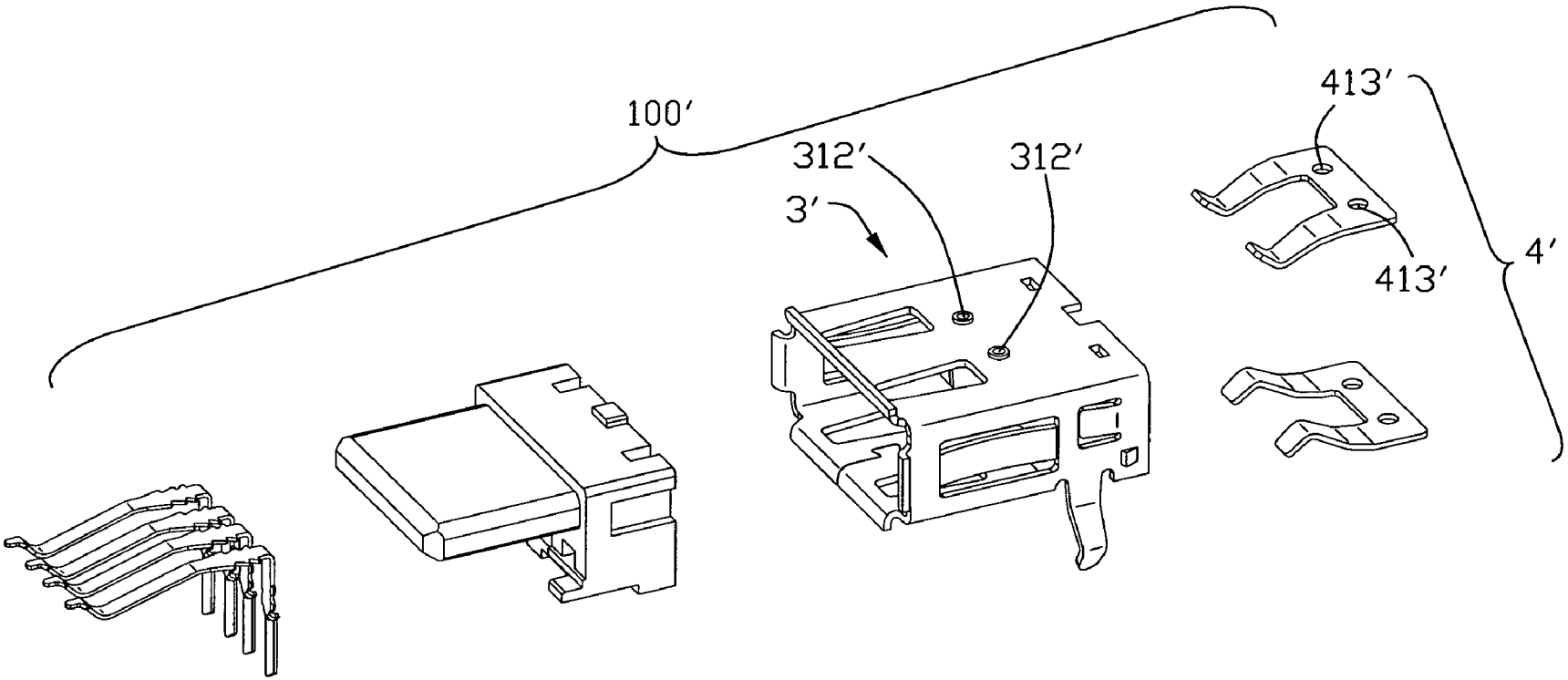
FIG. 7 is an exploded view of the electrical connector shown in FIG. 6.
Figure 8:
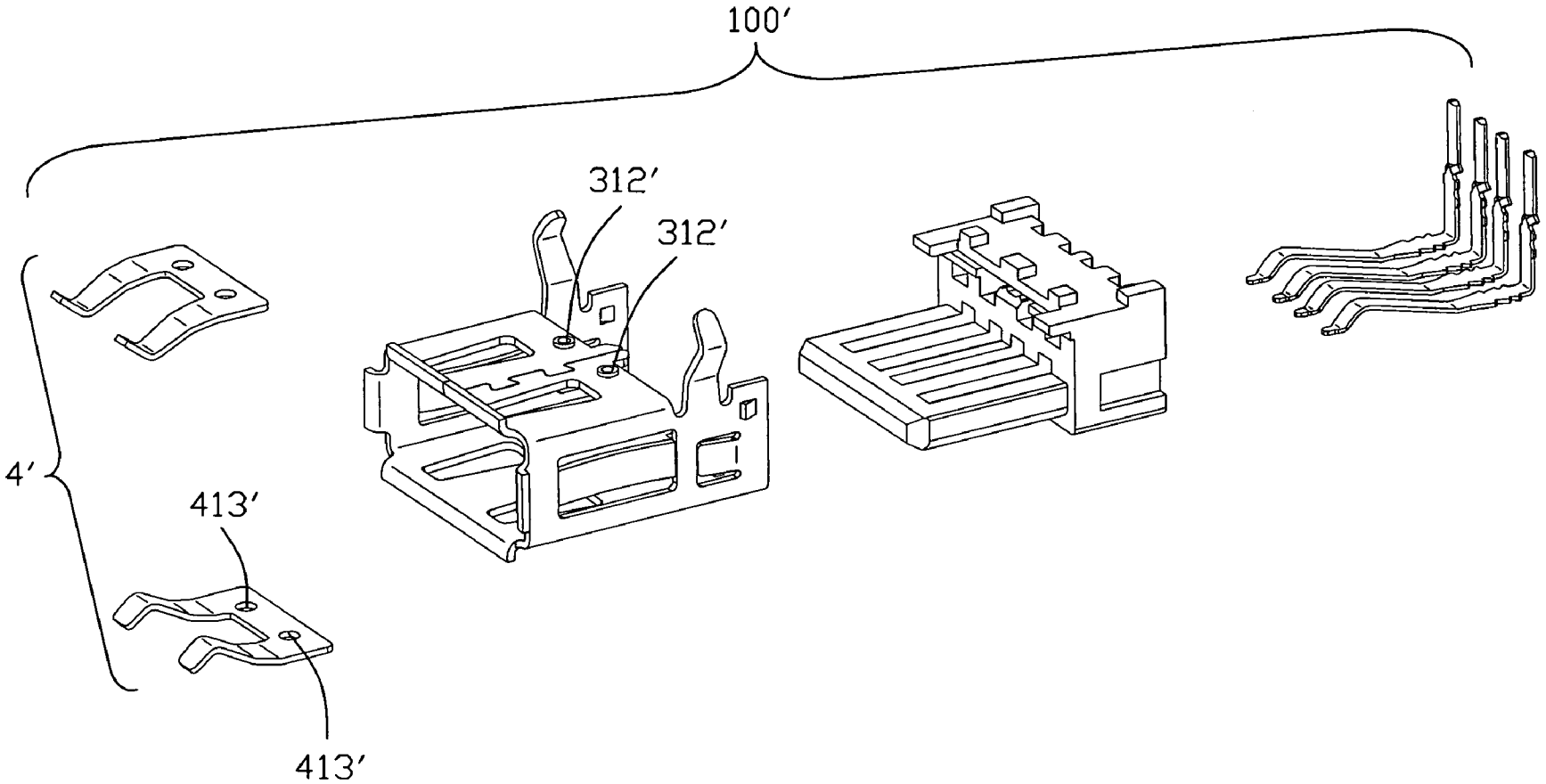
FIG. 8 is another exploded view similar to FIG. 7, while taken from another aspect.
Figure 9:
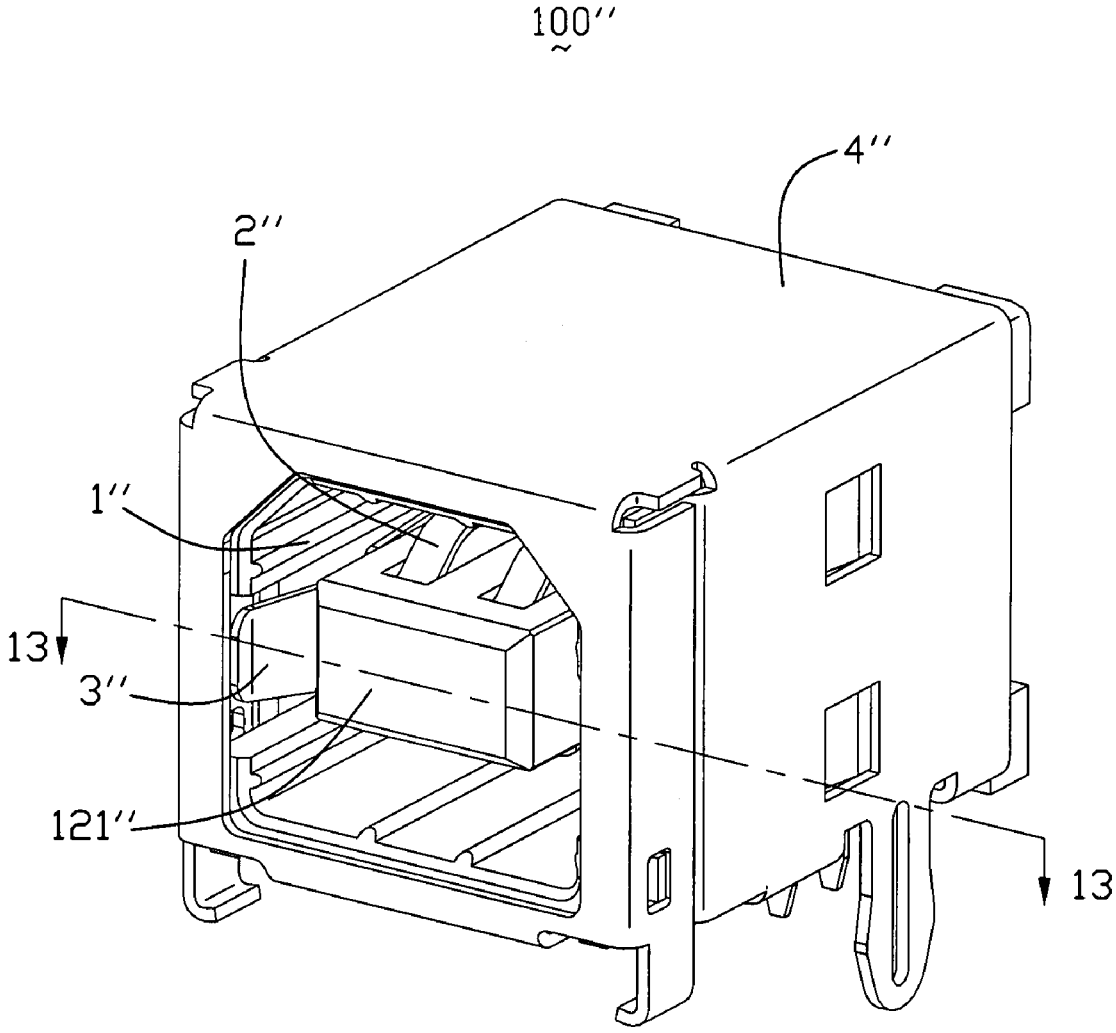
FIG. 9 is a front perspective view of an electrical connector according to a third embodiment of the present invention.
Figure 10:
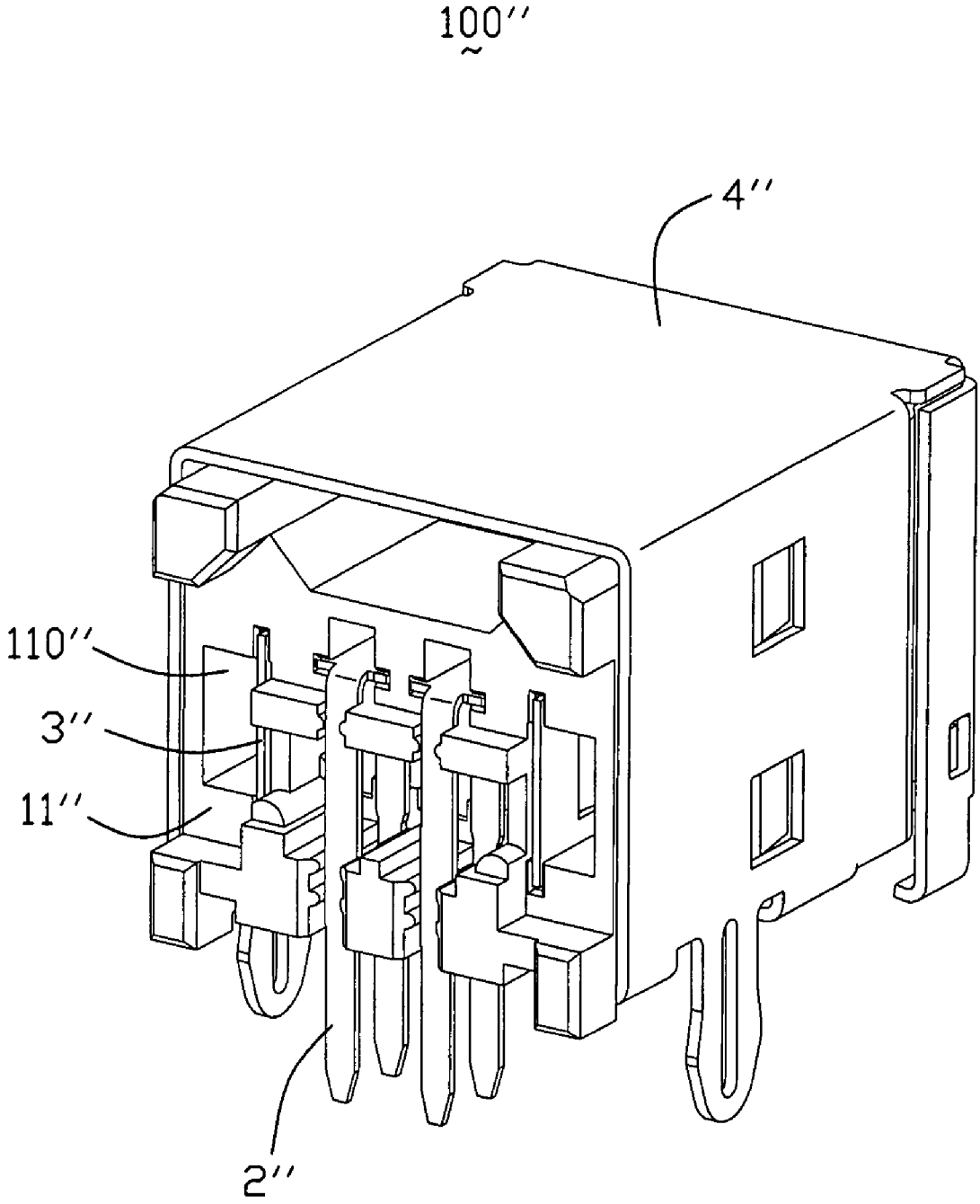
FIG. 10 is a rear perspective view similar to FIG. 9, but viewed from another aspect.

Referring to FIGS. 6-8, an electrical connector 100' according to a second embodiment of the present invention is disclosed. The electrical connector 100' in the second embodiment only has a singe interface while the electrical connector 100 in the first embodiment is in a stacked manner. Of course, the electrical connector 100 can only set a single interface which is easy to be made under principle similar to the stacked one. The electrical connector 100' is similar to the electrical connector 100 in the first embodiment in most aspects. The electrical connector 100' comprises a pair of metal springs 4' each defining a pair of through holes 413' and a metal shield 3' comprises two pairs of protrusions 312' for mating with the through holes 413'. The metal springs 4' are of the same configuration as the first metal spring 41 of the electrical connector 100. The main difference between the electrical connector 100 in the first embodiment and the electrical connector 100' in the second embodiment is that the protrusions 312' are integrally fixed in the through holes 413' via laser welding technology. As a result, the pair of metal springs 4' are stably fixed on the metal shield 3'.

Referring to FIGS. 9-13, an electrical connector 100" according to a third embodiment of the present invention is disclosed. The electrical connector 100" comprises an insulative housing 1", a plurality of contacts 2" retained in the insulative housing 1", a pair of metal springs 3" and a tube shaped metal shield 4" enclosing the insulative housing 1".

Figure 11:
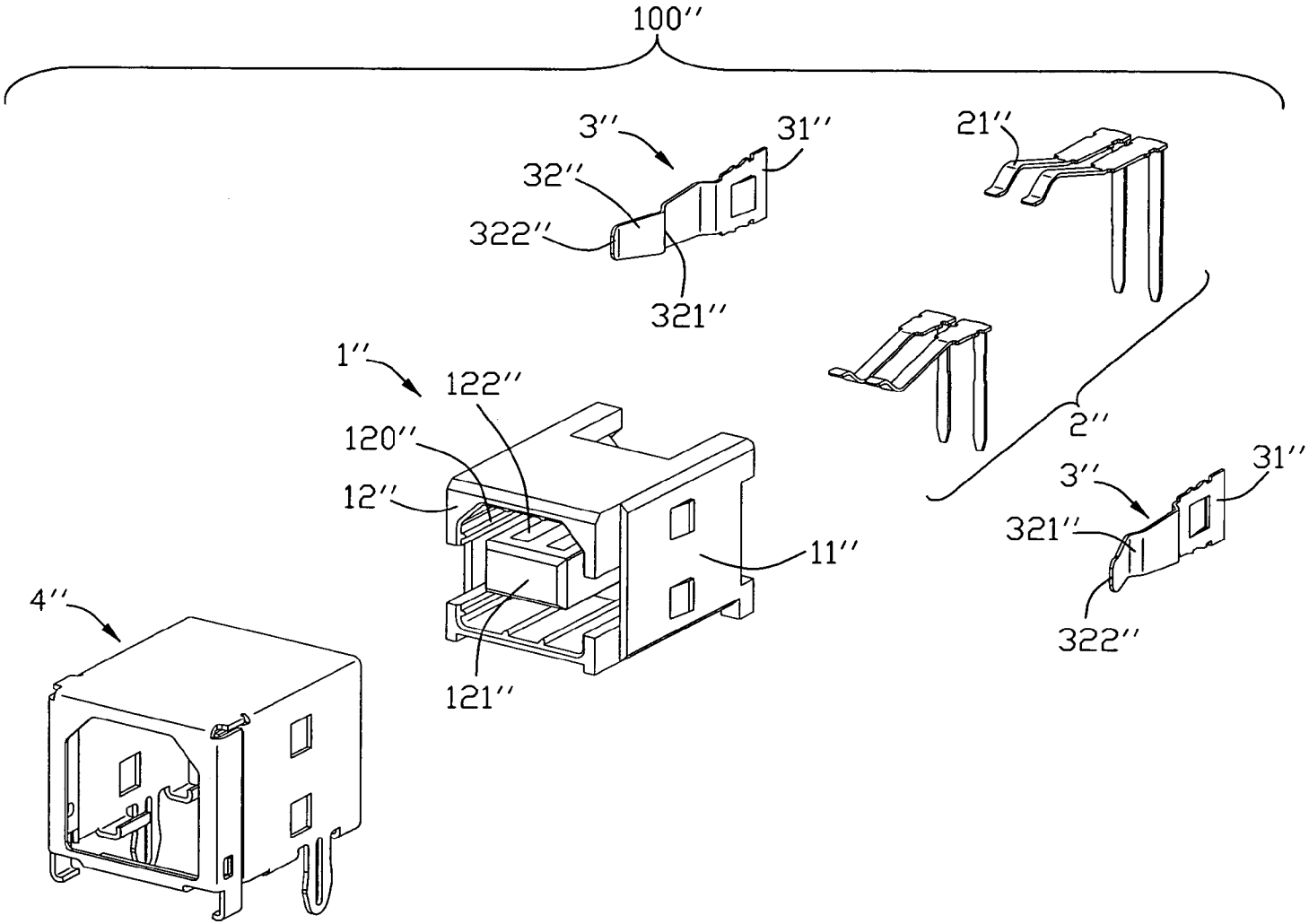
FIG. 11 is an exploded view of the electrical connector shown in FIG. 9.
Figure 12:
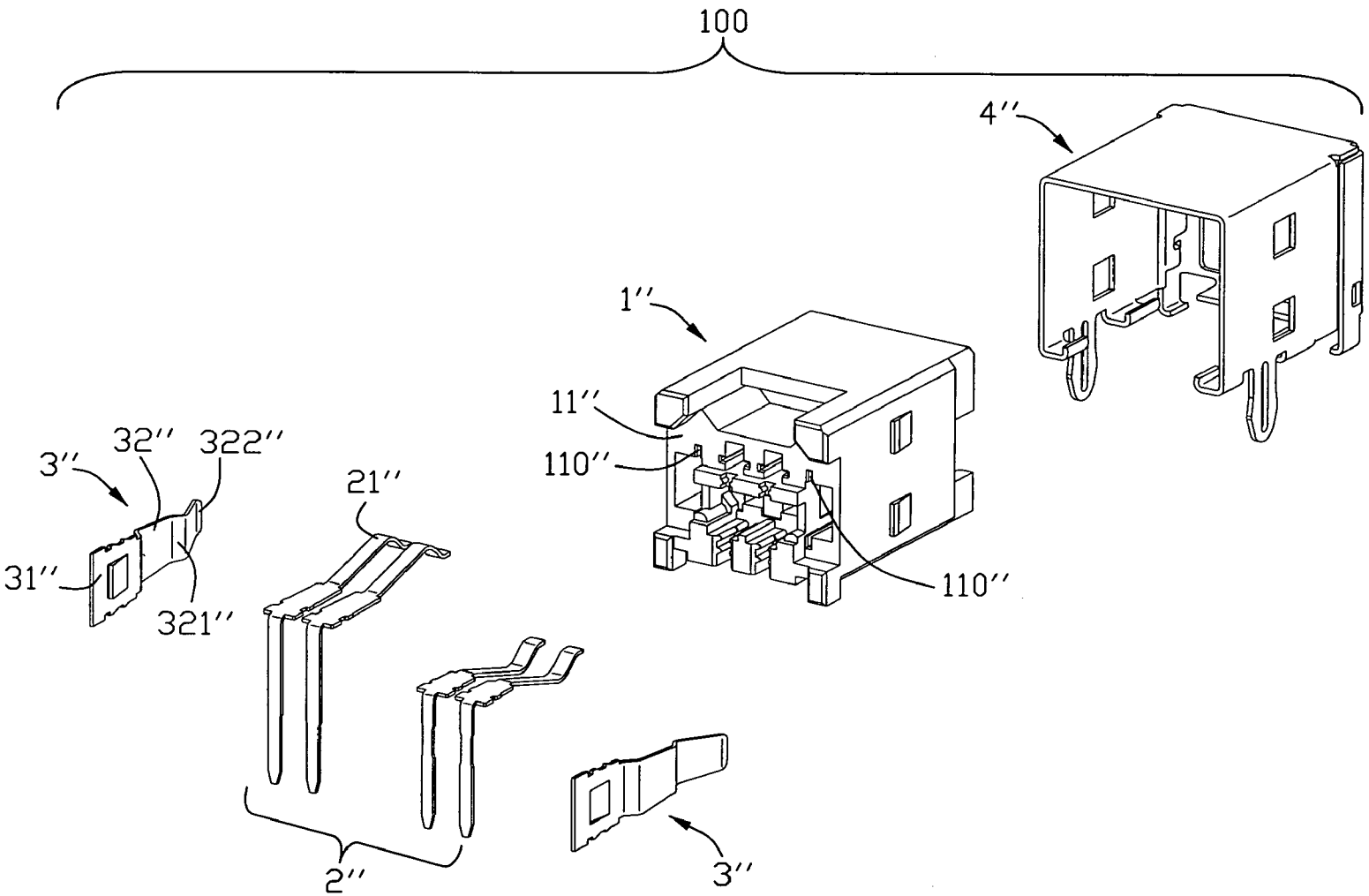
FIG. 12 is another exploded view similar to FIG. 11, but viewed from another aspect.

The insulative housing 1" comprises a base portion 11" and an extending portion 12" protruding forwardly from the base portion 11" as shown in FIG. 11. The extending portion 12" defines a receiving cavity 120" therein and a tongue plate portion 121" surrounded by the receiving cavity 120". The tongue plate portion 121" defines two pairs of passageways 122" on top and bottom surfaces thereof, respectively, for receiving the contacts 2". The base portion 11" comprises a pair of slits 110" on lateral sides thereof and communicating with the receiving cavity 120" for receiving the metal springs 3".

The plurality of contacts 2" comprise a plurality of contact portions 21" protruding into the receiving cavity 120" for mating with an inserted plug.

Figure 13:
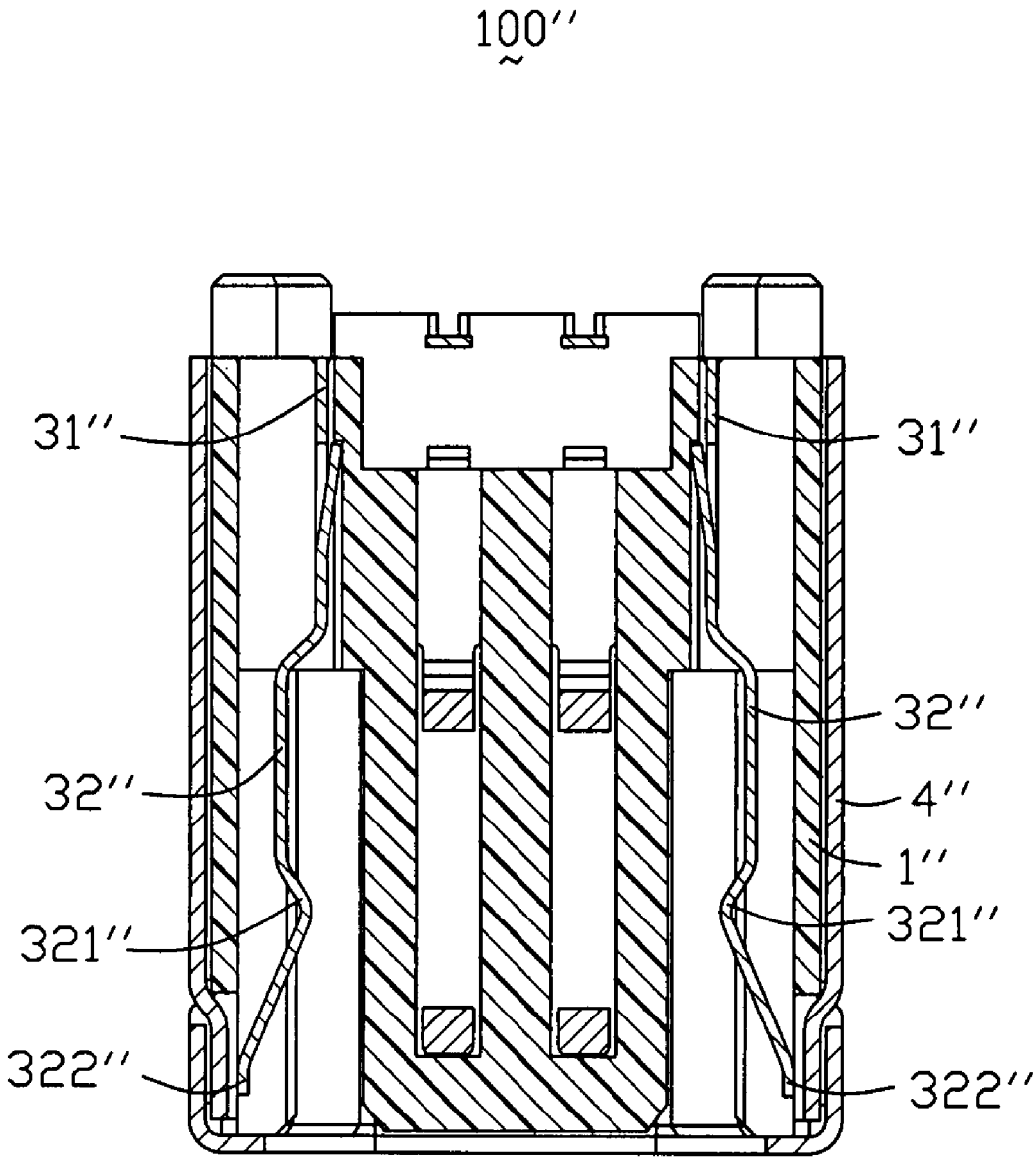
FIG. 13 is a schematic cross-sectional view of the electrical connector taken along line 13-13 of FIG. 9.

The metal springs 3" are inserted into the slits 110" along a rear-to-front direction. Each metal spring 3" comprises a retaining portion 31" fixed to the base portion 11" and an engaging arm 32" integrally extending forwardly from the retaining portion 31". The engaging arm 32" comprises an engaging portion 321" protruding into the receiving cavity 120" for abutting against the plug and a grounding contact portion 322" on a distal end thereof as shown in FIG. 13. The grounding contact portion 322" is adapted to attach the meal shield 4" with insertion of the plug for grounding function.

Figure 14:
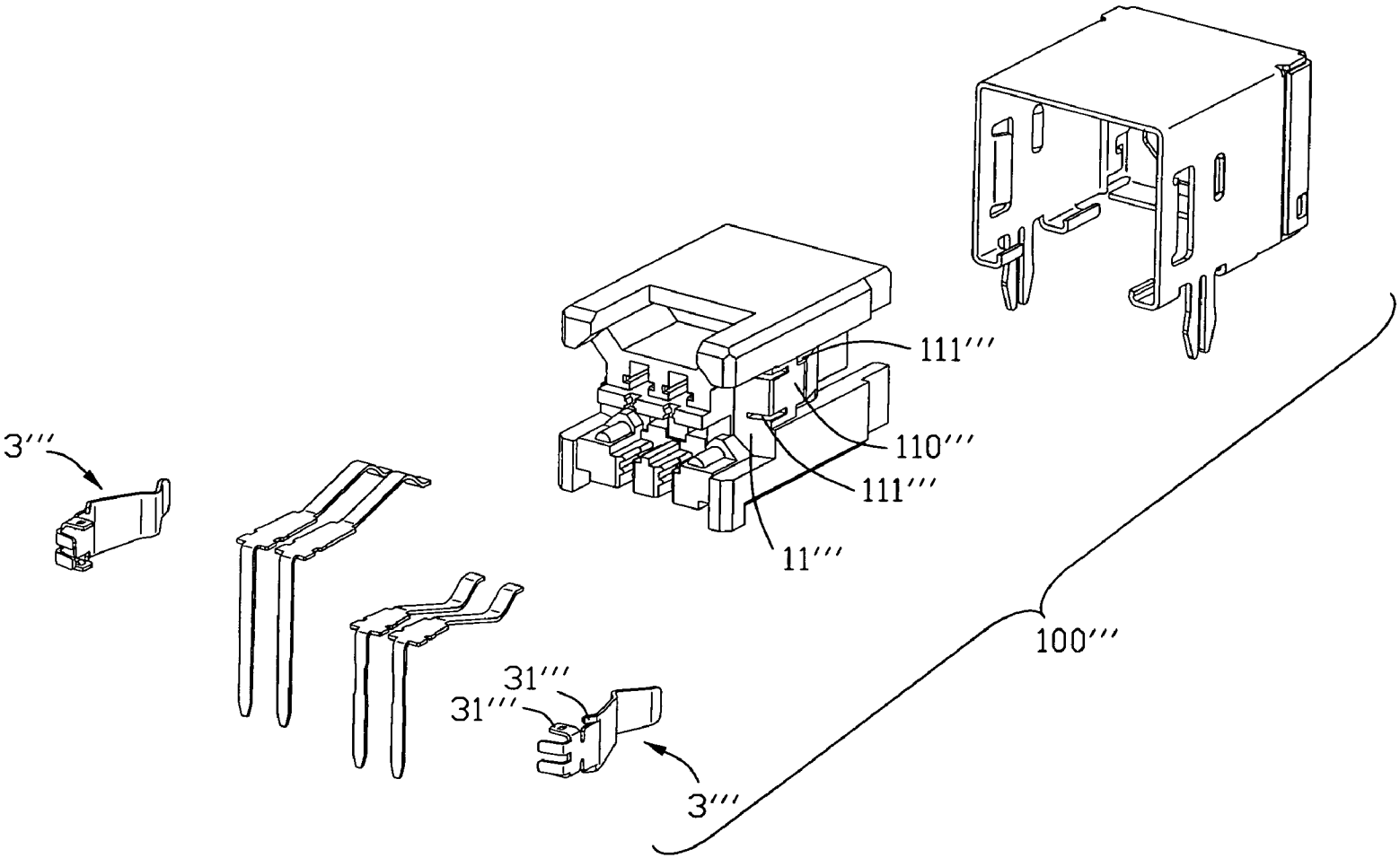
FIG. 14 is an exploded view of an electrical connector according to a fourth embodiment of the present invention.
Figure 15:
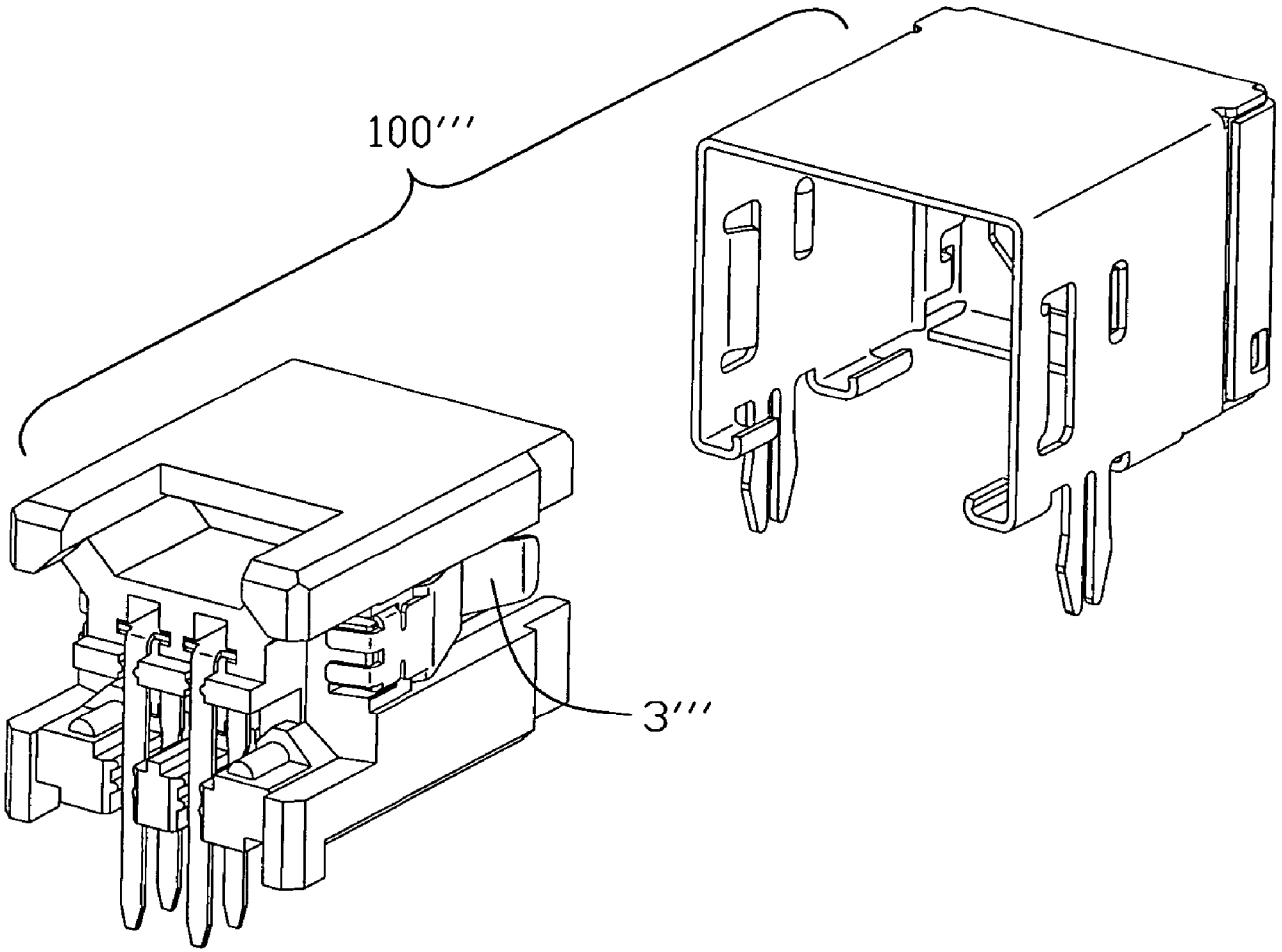
FIG. 15 is a partly assembled view of FIG. 14 showing an engaging arm laterally fixed in an insulative housing of the electrical connector.
Figure 16:
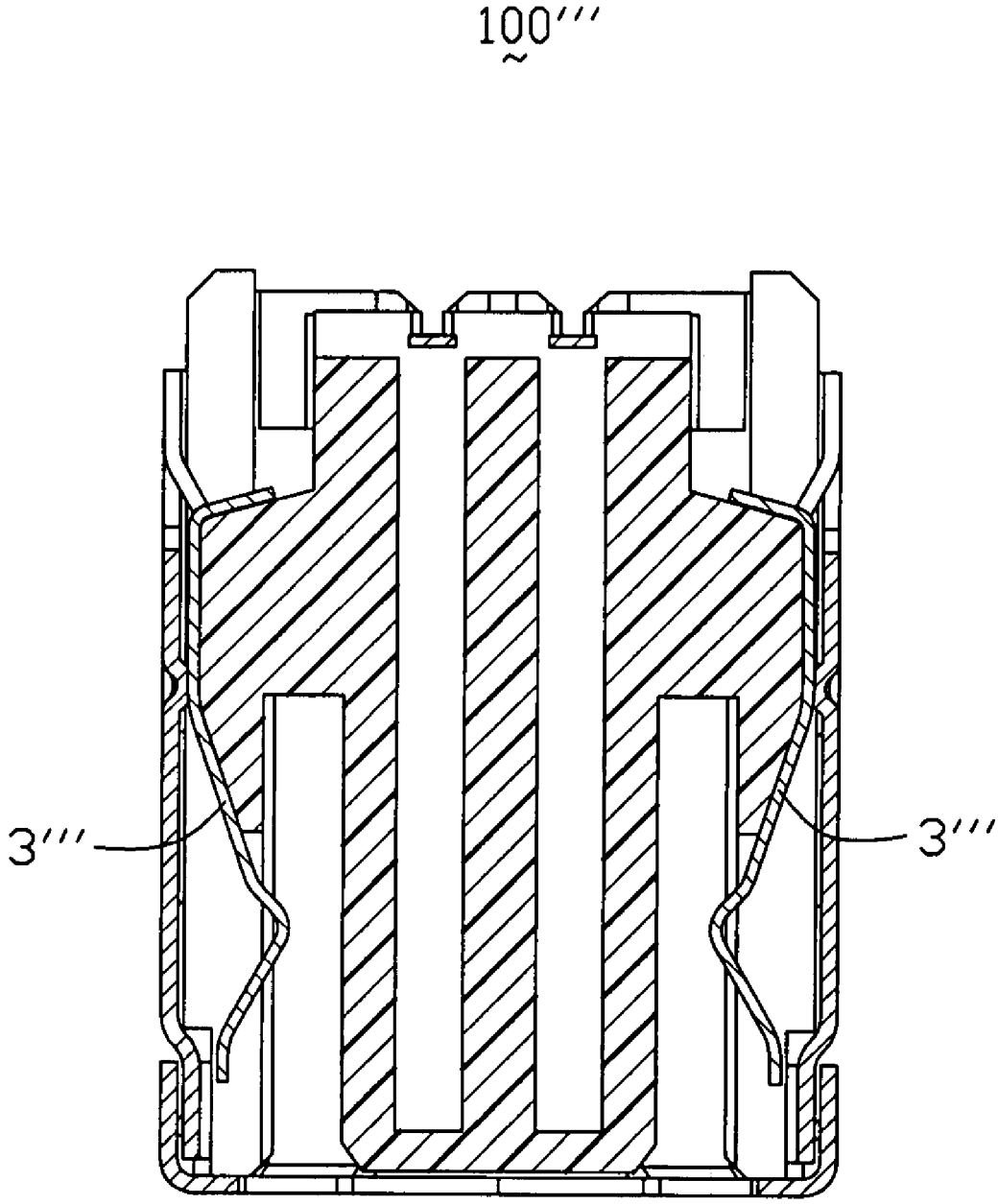
FIG. 16 is a schematic cross-sectional view of the electrical connector.

Referring to FIGS. 14-16, an electrical connector 100''' according to a fourth embodiment of the present invention is disclosed. The electrical connector 100''' is similar to the electrical connector 100" of the third embodiment while the difference between them is that the electrical connector 100''' comprises a base portion 11''' defining a pair of depressions 110''' on lateral sides thereof for retaining a pair of metal springs 3'''. The base portion 11''' further defines a plurality of slots 111''' laterally in each of the depression 110'''. Each metal spring 3''' comprises a plurality of projections 31''' received in the slots 111''' when the metal springs 3''' are assembled to the base portion 11''' along a lateral direction.

According to the present invention, the metal shields 3, 3', 4", 4''' and the metal springs 4, 4', 3", 3''' are made of different materials. The metal shields 3, 3', 4", 4''' are made of common iron sheet while the metal springs 4, 4', 3", 3''' are made of material with excellent mechanical property, such as stainless steel in order to provide longtime mating cycles while mating with corresponding plug. It is obvious that iron is much cheaper that stainless steel, thereby, the cost of the electrical connectors 100, 100', 100", 100''' is decreased.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing comprising a tongue plate portion;

a plurality of contacts retained in the tongue plate portion, the contacts comprising a plurality of contact portions;

a metal shield covering the tongue plate portion and defining a receiving cavity into which the tongue plate portion extends, the receiving cavity being formed by a plurality of peripheral walls, the peripheral walls including a mounting wall which defines a slot communicating with the receiving cavity; and a metal spring being made of a kind of material different from that of the metal shield, wherein the metal spring is fixed to the mounting wall and comprises an engaging arm extending through the slot and into the receiving cavity; the metal spring defining a through hole disposed at a distal end thereof; the through hole receiving a protrusion located perpendicular to and on the mounting wall; another through hole is adjacent to the through hole and receives a second projection located on the mounting wall; and the metal spring further comprises a fixed portion and another engaging arm, the engaging arm and the another engaging arm extending from lateral sides of the fixed portion, the mounting wall defining another slot through which the another engaging arm extends into the receiving cavity.

2. The electrical connector according to claim 1, wherein the insulative housing comprises a base portion with the tongue plate portion extending forwardly therefrom, the tongue plate portion defining a plurality of passageways to receive the contacts.

3. The electrical connector according to claim 1, wherein the protrusion is integrally fixed in the through hole through laser welding technology.

4. The electrical connector according to claim 1, wherein the protrusion is riveted outwardly to abut against the metal spring.

5. The electrical connector according to claim 1, wherein the metal spring is attached to an outer surface of the mounting wall.

6. The electrical connector according to claim 1, wherein the mounting wall is a top wall or a bottom wall of the metal shield.

7. An electrical connector adapted for mating with a plug, comprising:

an insulative housing comprising a base portion and an extending portion protruding forwardly from the base portion, the extending portion defining a receiving cavity and a tongue plate portion surrounded by the receiving cavity;

a plurality of contacts retained in the tongue plate portion, the contacts comprising a plurality of contact portions protruding into the receiving cavity for mating with the plug;

a metal spring comprising a retaining portion fixed to the base portion and an engaging arm integrally extending from the retaining portion, the engaging arm comprising an engaging portion protruding into the receiving cavity for abutting against the plug and a grounding contact portion on a distal end thereof; and a metal shield covering the insulative housing, the grounding contact portion being adapted to make contact with the metal shield during insertion of the plug into the receiving cavity.

8. The electrical connector according to claim 7, wherein the tongue plate portion extends along a rear-to-front direction, the metal spring extending along a direction the same as that of the tongue plate portion.

9. The electrical connector according to claim 8, wherein the metal spring is secured to the base portion along the rear-to-front direction.

10. The electrical connector according to claim 9, wherein the base portion defines at least one slit on a lateral side thereof to receive the retaining portion of the metal spring.

11. The electrical connector according to claim 7, wherein the base portion defines a depression on a lateral side thereof and a plurality of slots in the depression, the metal spring being secured to the base portion laterally, and wherein the metal spring comprises a plurality of projections received in the slots.

12. An electrical connector comprising:

an insulative housing;

a plurality of contacts disposed in the housing, each of said contacts having a mating portion;

a metallic shell enclosing the housing and cooperating with the housing commonly defining a mating port to which said mating portion is exposed and in which a complementary connector is snugly received;

at least one metallic spring tang made of material different from that of the shell while mechanically and electrically engaged to the shell and further extending into the mating port for efficiently holding said complementary connector in said mating port, the metallic spring tang defining a through hole disposed at a distal end thereof; the through hole receiving a protrusion located perpendicular to and on a mounting wall; another through hole is adjacent to the through hole and receives a second projection located on the mounting wall; and the metallic spring tang further comprises a fixed portion and another engaging arm, the engaging arm and the another engaging arm extending from lateral sides of the fixed portion, the mounting wall defining another slot through which the another engaging arm extends into the receiving cavity.

13. The connector as claimed in claim 12, wherein said shell defines an opening through which the spring tang extends from an exterior into the mating port.

14. The connector as claimed in claim 12, wherein the material of said shell is thinner or weaker than that of the spring tang so as to assure the shell can be easier formed to cover the housing and the spring tang is able to endure significant insertion force during mating.

* * * * *